US011215191B2

(12) United States Patent
Tokuno

(10) Patent No.: US 11,215,191 B2
(45) Date of Patent: Jan. 4, 2022

(54) BLOWER

(71) Applicant: Nidec Corporation, Kyoto (JP)

(72) Inventor: Yuta Tokuno, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 116 days.

(21) Appl. No.: 16/711,486

(22) Filed: Dec. 12, 2019

(65) Prior Publication Data

US 2020/0208646 A1 Jul. 2, 2020

(30) Foreign Application Priority Data

Dec. 28, 2018 (JP) ..... JP2018-248648

(51) Int. Cl.

| | |
|---|---|
| ***F04D 25/06*** | (2006.01) |
| ***F04D 19/00*** | (2006.01) |
| ***F04D 29/38*** | (2006.01) |
| ***F04D 29/54*** | (2006.01) |
| ***F04D 29/42*** | (2006.01) |
| ***F04D 25/08*** | (2006.01) |
| ***F04D 29/66*** | (2006.01) |

(52) U.S. Cl.

CPC ..... *F04D 29/38* (2013.01); *F04D 25/0646* (2013.01); *F04D 25/08* (2013.01); *F04D 29/4226* (2013.01); *F04D 29/4253* (2013.01); *F04D 29/54* (2013.01); *F04D 29/666* (2013.01); *F04D 29/667* (2013.01); *F04D 19/002* (2013.01)

(58) Field of Classification Search

CPC .... F04D 29/522; F04D 29/70; F04D 29/4226; F04D 29/4253; F04D 19/022; F04D 25/0646; F04D 19/002; F04D 29/667; F04D 29/666; F04D 29/5813

See application file for complete search history.

(56) References Cited

U.S. PATENT DOCUMENTS

| | | | | |
|---|---|---|---|---|
| 6,468,054 | B1 * | 10/2002 | Anthony | F04D 25/12 417/360 |
| 9,599,115 | B2 * | 3/2017 | Chou | F04D 29/384 |
| 10,697,466 | B2 * | 6/2020 | Hakozaki | F04D 29/384 |
| 2012/0230815 | A1 | 9/2012 | Teramoto et al. | |
| 2018/0100518 | A1 * | 4/2018 | Sun | F04D 19/007 |
| 2018/0156229 | A1 | 6/2018 | Liu et al. | |

FOREIGN PATENT DOCUMENTS

| | | | |
|---|---|---|---|
| CN | 108180154 | A | 6/2018 |
| JP | 2004-183649 | A | 7/2004 |
| JP | 2005-076590 | A | 3/2005 |

* cited by examiner

*Primary Examiner* — Woody A Lee, Jr.
*Assistant Examiner* — Brian Christopher Delrue
(74) *Attorney, Agent, or Firm* — Keating & Bennett

(57) ABSTRACT

A blower includes a rotor blade rotatable about a central axis extending in an axial direction, a motor that rotates the rotor blade, and a housing that surrounds the rotor blade and the motor. The housing includes stator blades extending in a forward rotation direction of the rotor blade toward an axially lower side of the blower, a porous wall including multiple holes arranged in both the radial direction and in the circumferential direction, and a cylinder portion extending in the axial direction and radially outward of the porous wall. The hole penetrates the porous wall through upper to lower surfaces thereof. The stator blade is axially below the rotor blade. An axially upper end portion of the porous wall is between an axially lower end portion of the rotor blade and an axially upper end portion of the stator blade.

9 Claims, 11 Drawing Sheets

BLOWER

CROSS REFERENCE TO RELATED APPLICATION

The present invention claims priority under 35 U.S.C. § 119 to Japanese Application No. 2018-248648 filed on Dec. 28, 2018, the entire contents of which are hereby incorporated herein by reference.

1. FIELD OF THE INVENTION

The present disclosure relates to a blower.

2. BACKGROUND

Conventionally, a blower has been known in which air sucked in from an intake port is sent out from an exhaust port by rotation of a rotor blade. For example, a conventional axial fan motor generates a suction airflow in a direction along the axis of rotation by rotating blades.

Here, the flow of air sent out from the rotor blade becomes more turbulent as the distance from the rotor blade increases. Hence, static pressure of the air in an air flow direction tends to decrease. For this reason, usually, multiple stator blades for straightening air are disposed downstream of the rotor blade in the air flow. This curbs the decrease in static pressure of the air in the air flow direction.

However, there are cases where the decrease in static pressure of the air in the air flow direction cannot be curbed sufficiently only by disposing stator blades. In such a case, air may backflow toward the rotor blade from between the stator blades, whereby the blowing efficiency of the blower may be reduced, for example.

SUMMARY

An example embodiment of a blower of the present disclosure includes a rotor blade that is rotatable about a central axis extending in an axial direction, a motor that rotates the rotor blade, and a housing that surrounds the rotor blade and the motor. The housing includes multiple stator blades extending in a forward rotation direction of the rotor blade toward an axially lower side of the blower, a porous wall including multiple holes arranged in both the radial direction and in the circumferential direction, and a cylinder portion extending in the axial direction and radially outward of the porous wall. The holes penetrate the porous wall through upper to lower surfaces thereof. The stator blade is disposed axially below the rotor blade. In the axial direction, an axially upper end portion of the porous wall is disposed between an axially lower end portion of the rotor blade and an axially upper end portion of the stator blade.

The above and other elements, features, steps, characteristics and advantages of the present disclosure will become more apparent from the following detailed description of the example embodiments with reference to the attached drawings.

DETAILED DESCRIPTION

Figure 1:
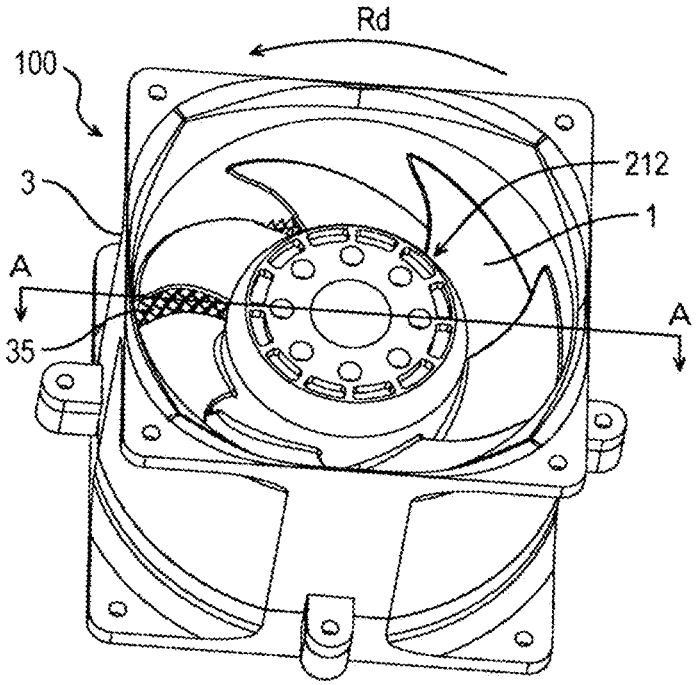
FIG. 1 is a perspective view of a blower according to an example embodiment of the present disclosure.

Hereinafter, example embodiments will be described with reference to the drawings.

Note that in the present specification, in a blower 100, a direction parallel to a central axis CA is referred to as "axial direction". Of the axial directions, a direction from a stator blade 32 to a rotor blade 1 described later is referred to as "axially upward", and a direction from the rotor blade 1 to the stator blade 32 is referred to as "axially downward". In each component, an end portion in the axially upper direction is referred to as "axially upper end portion", and the position of the axially upper end portion in the axial direction is referred to as "axial upper end". Further, an end portion in the axially lower direction is referred to as "axially lower end portion", and the position of the axially lower end portion in the axial direction is referred to as "axial lower end". Additionally, of the surfaces of each component, a surface facing the axially upper direction is referred to as "upper surface", and a surface facing the axially lower direction is referred to as "lower surface".

A direction orthogonal to the central axis CA is referred to as "radial direction". Of the radial directions, a direction approaching the central axis CA is referred to as "radially inward", and a direction separating from the central axis CA is referred to as "radially outward". In each component, an end portion in the radially inner direction is referred to as "radially inner end portion", and the position of the radially inner end portion in the radial direction is referred to as "radial inner end". Further, an end portion in the radially outer direction is referred to as "radially outer end portion", and the position of the radially outer end portion in the radial direction is referred to as "radial outer end". Additionally, of the side surfaces of each component, a side surface facing the radially inner direction is referred to as "radially inner side surface", and a side surface facing the radially outer direction is referred to as "radially outer side surface".

A direction in which the rotor blade 1 rotates about the central axis CA is referred to as "circumferential direction". Of the circumferential directions, a direction in which the rotor blade 1 rotating about the central axis CA travels is referred to as "forward rotation direction Rd". In each component, an end portion in the circumferential direction is referred to as "circumferential end portion", and the position of the circumferential end portion in the circumferential direction is referred to as "circumferential end". Additionally, of the side surfaces of each component, a surface facing the circumferential direction is referred to as "circumferential side surface".

In the present specification, "annular" is a shape that does not have a cut and is continuously connected over the entire circumference in the circumferential direction centered on the central axis CA. In addition, "annular" includes an arc shape having a cut in a part of the entire circumference centered on the central axis CA.

Note that the above-mentioned names of directions, parts, positions, and surfaces, and the above-mentioned definition of "annular" are names and definition of shape for use in the description of the present specification, and are not intended to limit names and shapes when incorporated into actual devices.

In the present specification, in modifications of the example embodiment, components similar to those of the example embodiment are assigned the same reference numerals, and descriptions may be omitted.

In a positional relationship between any one and another of the azimuths, lines, and surfaces, "parallel" includes not only a state in which the two endlessly extend without intersecting, but also a state in which the two are substantially parallel. Additionally, "vertical" and "orthogonal" include not only a state in which the two intersect at 90 degrees, but also a state in which the two are substantially vertical and a state in which the two are substantially orthogonal. That is, each of "parallel", "vertical", and "orthogonal" includes a state in which there is an angle shift that does not depart from the gist of the present disclosure.

When any one and another of the azimuths, lines, and surfaces intersect and the angle between the two is not 90 degrees, it is expressed that the two intersect at an acute angle. Note that needless to mention from a geometric point of view, this expression is synonymous with the fact that they intersect at an obtuse angle.

Figure 2:
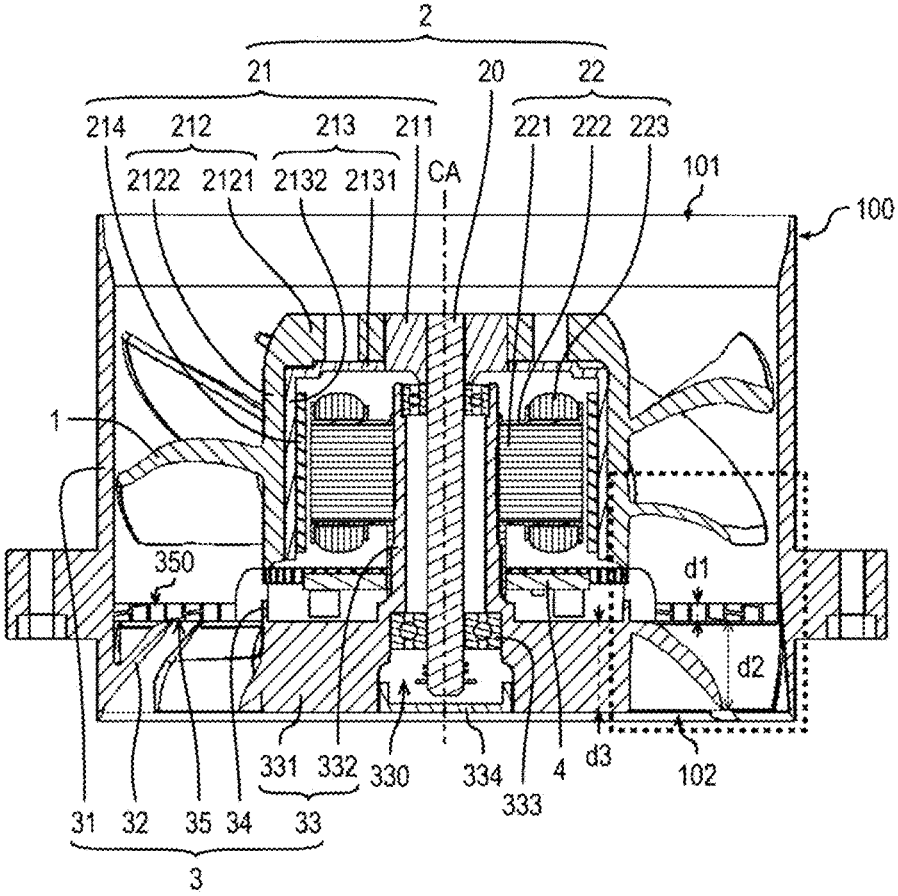
FIG. 2 is a cross-sectional view of the blower according to an example embodiment of the present disclosure.

FIG. 1 is a perspective view showing the blower 100 according to the example embodiment. FIG. 2 is a cross-sectional view showing the blower 100 according to the example embodiment. Note that FIG. 2 shows a cross-sectional structure taken along line A-A in FIG. 1. FIG. 2 shows a cross-sectional structure when the blower 100 is virtually cut along a plane including the central axis CA.

The blower 100 according to the example embodiment is an axial fan, and sends out air sucked in through an intake port 101 axially downward from an exhaust port 102. As shown in FIGS. 1 and 2, the blower 100 includes the rotor blade 1, a motor 2, a housing 3, and a substrate 4. The rotor blade 1 is rotatable about the central axis CA extending in the vertical direction. The motor 2 rotates the rotor blade 1. The housing 3 surrounds the rotor blade 1 and the motor 2.

The rotor blade 1 is provided on a radially outer side surface of the motor 2 in the example embodiment. More specifically, in the radial direction, the rotor blade 1 extends radially outward from a radially outer side surface of a rotor 21 described later of the motor 2. Note that the rotor blade 1 is not limited to the example of the example embodiment, and may be a part of an impeller (not shown) attached to the motor 2. In such a case, the blower 100 includes an impeller. For example, the impeller may have a base portion attached to the rotor 21, and the rotor blade 1 may be provided on the base portion.

In the axial direction, the rotor blade 1 extends in the forward rotation direction Rd toward the axially upper side. The rotor blade 1 sends out air by being rotated in the forward rotation direction Rd about the central axis CA by the motor 2. The air swirls in the forward rotation direction Rd about the central axis CA and flows axially downward.

As shown in FIG. 2, the motor 2 includes a shaft 20, the rotor 21, and a stator 22.

The shaft 20 is the axis of rotation of the rotor 21, supports the rotor 21, and can rotate with the rotor 21 about the central axis CA. Note that the shaft 20 is not limited to the example of the example embodiment, and may be a fixed shaft attached to the stator 22. Note that when the shaft 20 is a fixed shaft, the rotor 21 is provided with a rotor bearing (not shown) between the shaft 20 and the rotor 21.

The rotor 21 can rotate with the rotor blade 1 about the central axis CA. The rotor 21 has a shaft holder 211, a covered cylindrical rotor base 212, a covered cylindrical rotor yoke 213, and a magnet portion 214. The shaft holder 211 is attached to an axially upper end portion of the shaft 20. The rotor base 212 has a rotor lid portion 2121 and a rotor cylinder portion 2122. The rotor lid portion 2121 has an annular shape and extends radially outward from the shaft holder 211. Additionally, a through hole (reference numeral not shown) is provided on an upper surface of the rotor lid portion 2121 for weight reduction. The rotor cylinder portion 2122 extends axially downward from a radially outer end portion of the rotor lid portion 2121. A radially inner end portion of the rotor blade 1 is connected to a radially outer side surface of the rotor cylinder portion 2122. The shaft holder 211 has a structure integrated with the rotor blade 1 in the example embodiment. The rotor yoke 213 is provided on an inner surface of the rotor base 212 and holds the magnet portion 214. The rotor yoke 213 has a yoke lid portion 2131 and a yoke cylinder portion 2132. The yoke lid portion 2131 has an annular shape and extends radially outward from the shaft holder 211. An upper surface of the yoke lid portion 2131 is fixed to a lower surface of the rotor lid portion 2121. The yoke cylinder portion 2132 extends axially downward from a radially outer end portion of the yoke lid portion 2131. A radially outer side surface of the yoke cylinder portion 2132 is fixed to a radially inner side surface of the rotor cylinder portion 2122. The magnet portion 214 is held on a radially inner side surface of the yoke cylinder portion 2132. The magnet portion 214 is located radially outward of the stator 22, and faces a radially outer side surface of the stator 22 with a gap interposed therebetween in the radial direction.

The stator 22 has an annular shape centered on the central axis CA. The stator 22 rotates the rotor 21 when the motor 2 is driven. The stator 22 has a stator core 221, an insulator 222, and a coil portion 223. The stator core 221 is an annular magnetic body centered on the central axis CA, and in the example embodiment, is a laminated body in which multiple plate-shaped magnetic steel sheets are laminated. A radially inner end portion of the stator core 221 is fixed to a radially outer side surface of a bearing holder 332 described later of the housing 3. A radially outer side surface of the stator core 221 faces the magnet portion 214 with a gap interposed therebetween in the radial direction. The insulator 222 is an electrically insulating member using a resin material or the like, and covers at least a part of the stator core 221. The coil portion 223 is a winding member in which a conducting wire is wound around the stator core 221 via the insulator 222.

Figure 3A:
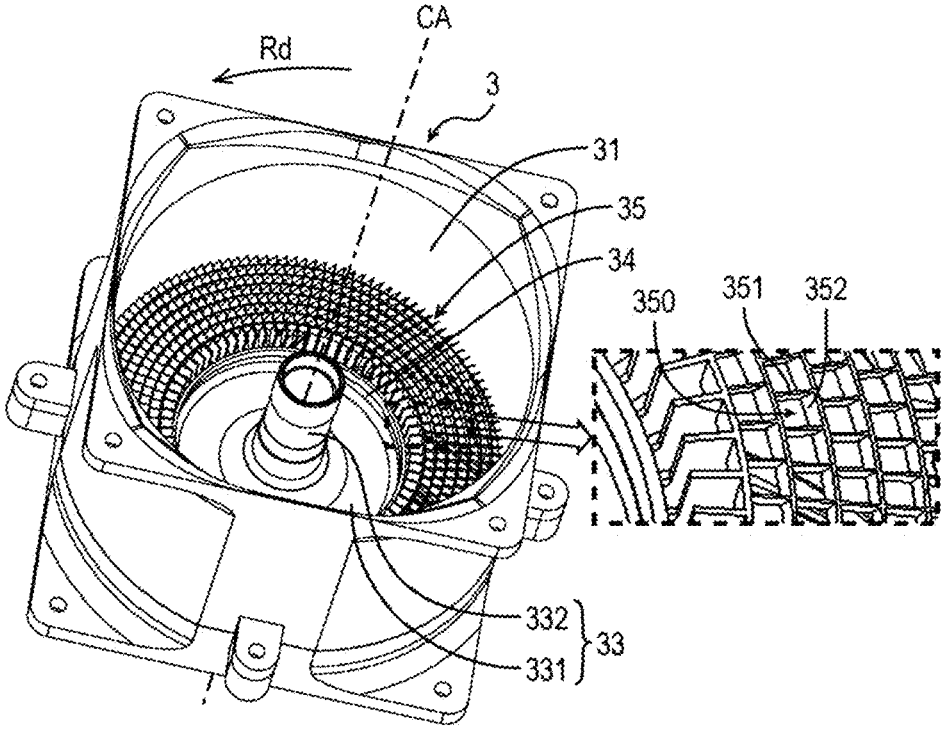
FIG. 3A is a perspective view of a housing as viewed from above in the axial direction.
Figure 3B:
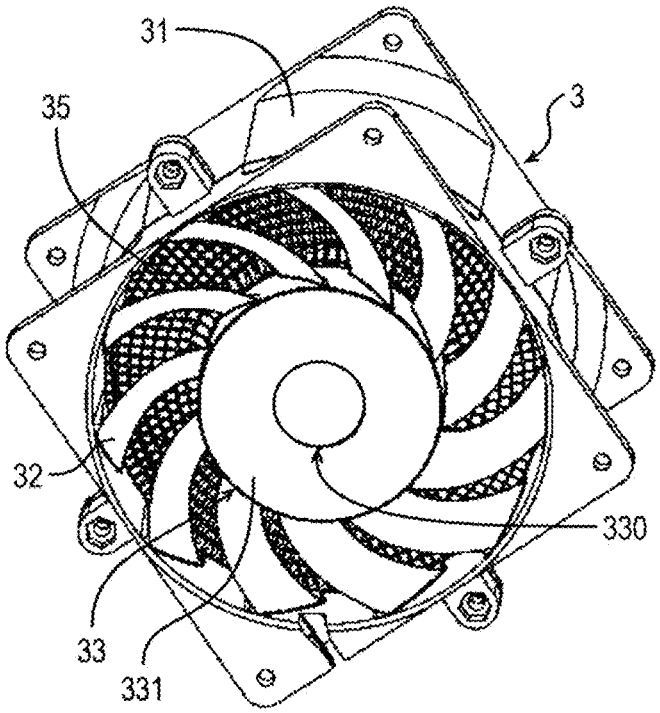
FIG. 3B is a perspective view of the housing as viewed from below in the axial direction.
Figure 3C:
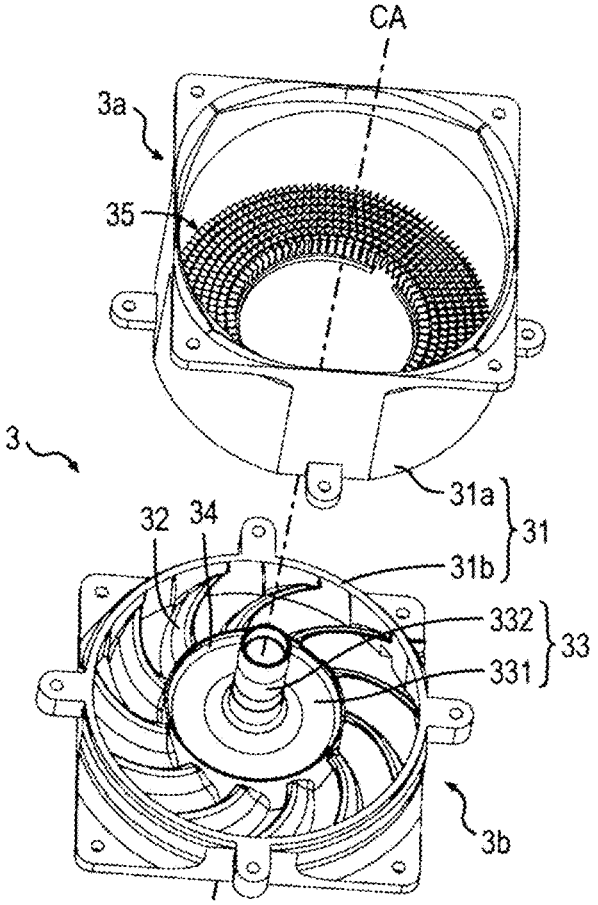
FIG. 3C is a perspective view showing another configuration example of the housing according to an example embodiment of the present disclosure.

Next, a configuration of the housing 3 will be described with reference to FIGS. 1 to 3C. FIG. 3A is a perspective view of the housing 3 as viewed from above in the axial direction. FIG. 3B is a perspective view of the housing 3 as viewed from below in the axial direction. FIG. 3C is a perspective view showing another configuration example of the housing 3.

The housing 3 has a cylinder portion 31, multiple stator blades 32, a motor holding portion 33, a side wall portion 34, and a porous wall 35.

The cylinder portion 31 extends in the axial direction and is disposed radially outward of the porous wall 35. As mentioned earlier, the housing 3 has the cylinder portion 31. The intake port 101 is provided in an axially upper end portion of the cylinder portion 31. The exhaust port 102 is provided in an axially lower end portion of the cylinder portion 31. The cylinder portion 31 accommodates the rotor blade 1, the motor 2, the stator blades 32, the motor holding portion 33, the side wall portion 34, and the porous wall 35. Here, in the example embodiment, the entire rotor blade 1 and all of the stator blades 32 are accommodated in the cylinder portion 31. Note, however, that the configuration is not limited to this example, and a part of the rotor blade 1 may be accommodated inside the cylinder portion 31, and other parts of the rotor blade 1 may be disposed outside the cylinder portion 31. Additionally, some of the stator blades 32 may be accommodated inside the cylinder portion 31, and the rest of the stator blades 32 may be disposed outside the cylinder portion 31.

In the example embodiment, a radially outer end portion of the stator blade 32 and a radially outer end portion of the porous wall 35 are connected to a radially inner side surface of the cylinder portion 31. That is, the cylinder portion 31, the stator blades 32, and the porous wall 35 have an integral structure.

However, the structure is not limited to the example of the example embodiment, and as shown in FIG. 3C, the cylinder portion 31 may have a first cylinder portion 31*a* and a second cylinder portion 31*b* connected to an axially lower end portion of the first cylinder portion 31*a*. The radially outer end portion of the porous wall 35 is connected to a radially inner side surface of the first cylinder portion 31*a*. The radially outer end portion of the stator blade 32 is connected to a radially inner side surface of the second cylinder portion 31*b*. More specifically, in FIG. 3C, the housing 3 has a first housing 3*a* and a second housing 3*b*. The first housing 3*a* has the first cylinder portion 31*a* and the porous wall 35. While the porous wall 35 has a structure integrated with the first cylinder portion 31*a* in FIG. 3C, the porous wall 35 is not limited to the example of FIG. 3C, and may be a member different from the first cylinder portion 31*a*. In such a case, the porous wall 35 may be attached to the inner side of the first cylinder portion 31*a*, for example. The second housing 3*b* has the second cylinder portion 31*b*, the multiple stator blades 32, the motor holding portion 33, and the side wall portion 34. Additionally, the multiple stator blades 32 have a structure integrated with the second cylinder portion 31*b*. With this configuration, as shown in FIG. 3C, for example, when the housing 3 is manufactured, the first housing 3*a* in which the porous wall 35 is provided on the radially inner side surface of the first cylinder portion 31*a*, and the second housing 3*b* in which the multiple stator blades 32 are provided on the radially inner side surface of the second cylinder portion 31*b* can be formed separately. Accordingly, the housing 3 can be manufactured more easily.

The stator blade 32 extends radially outward from the motor holding portion 33 and is connected to the cylinder portion 31. In other words, a radially inner end portion of the stator blade 32 is connected to a radially outer side surface of the motor holding portion 33. The radially outer end portion of the stator blade 32 is connected to the radially inner side surface of the cylinder portion 31. In the axial direction, the stator blade 32 is disposed axially downward of the rotor blade 1. In the axial direction, the stator blade 32 extends in the forward rotation direction Rd of the rotor blade 1 toward the axially lower side. As mentioned earlier, the housing 3 has the stator blade 32. When viewed in the axial direction, the stator blade 32 is tilted in the opposite direction from the rotor blade 1. This can reduce noise.

The motor holding portion 33 is supported by the cylinder portion 31 via the stator blades 32, and holds the motor 2. More specifically, the motor holding portion 33 has a bracket 331 and the bearing holder 332. The bracket 331 has an annular shape surrounding the central axis CA. The annular side wall portion 34 protruding axially upward is provided in a radially outer end portion of the bracket 331. The bearing holder 332 has a cylindrical shape and extends axially upward from a radially inner end portion of the bracket 331. The bearing holder 332 holds the stator 22. The stator core 221 is fixed to a radially outer side surface of the bearing holder 332.

A central hole 330 that penetrates the motor holding portion 33 in the axial direction is provided in a central portion of the motor holding portion 33. The shaft 20 is inserted through the central hole 330 of the motor holding portion 33 in the axial direction. Additionally, a bearing 333 is provided on a radially inner side surface of the motor holding portion 33 in the central hole 330. The motor holding portion 33 supports the shaft 20 via a bearing 333 such that the shaft 20 is rotatable. An axially lower end portion of the central hole 330 is covered with a cap 334.

Next, the porous wall 35 is provided with multiple holes 350 arranged both in the radial direction and in the circumferential direction. As mentioned earlier, the housing 3 has the porous wall 35. The porous wall 35 has the multiple holes 350. Each hole 350 penetrates the porous wall 35 through upper to lower surfaces thereof. Air sent out axially downward from the rotor blade 1 is straightened by passing through the holes 350.

In the example embodiment, as shown in FIG. 2, in the axial direction, at least an axially upper end portion of the porous wall 35 is disposed between an axially lower end portion of the rotor blade 1 and an axially upper end portion of the stator blade 32. The flow of air generated by the rotor blade 1 is sent out of the blower 100 through the each hole 350 of the porous wall 35 and between the stator blades 32. At this time, the air flow is evenly straightened by passing through the each hole 350 of the porous wall 35, and a stronger directivity is generated in the air flow direction. For this reason, the dynamic pressure of air flowing into gaps between the stator blades 32 through the each hole 350 can be increased even more. Accordingly, compared to a configuration in which at least a part of the porous wall 35 is not provided between the stator blade 32 and the rotor blade 1, air is less likely to backflow through the gaps between the stator blades 32. Hence, it is possible to restrain or prevent stalling of the rotor blade 1 due to backflow of air toward the rotor blade 1. Further, in the example embodiment, compared to a configuration in which the porous wall 35 is not provided between the stator blade 32 and the rotor blade 1, and the porous wall 35 is provided between axially lower portions of the stator blades 32 adjacent in the circumferential direction, backflow of air toward the rotor blade 1 can be reduced, and static pressure and the air blow amount of the blower 100 can be increased even more. Specifically, the porous wall 35 is closer to the rotor blade 1 in the axial direction than the stator blade 32. With this configuration, since the porous wall 35 is less likely to stall the air flow than the stator blade 32, the air is allowed to pass through the porous wall 35 while maintaining the flow velocity. Accordingly, since the air from the rotor blade 1 maintains its flow velocity even after passing through the porous wall 35, backflow toward the rotor blade 1 can be reduced, and more air flows toward the stator blade 32. Hence, static pressure can be increased. As a result, since static pressure and the air blow amount can be increased, the air blowing efficiency of the blower 100 is improved.

Furthermore, in the axial direction, the axially lower end portion of the rotor blade 1 and the axially upper end portion of the stator blade 32 face each other with at least the axially upper end portion of the porous wall 35 interposed therebetween. That is, since the two do not face each other directly, noise generated during blowing can be reduced.

A radially inner end portion of the porous wall 35 is preferably disposed radially outward of a gap in the axial direction between an axially lower end portion of the rotor cylinder portion 2122 and an axially upper end portion of the side wall portion 34 of the housing 3 as in the example embodiment. The axial position of the radially inner end portion of the porous wall 35 overlaps the axial position of the gap. With this configuration, air flowing in the vicinity of the radially outer side surface of the rotor cylinder portion 2122 can also be straightened by the porous wall 35.

In the example embodiment, as shown in FIG. 2, the lower surface of the porous wall 35 is in contact with the axially upper end portion of the stator blade 32. This eliminates any space between the porous wall 35 and the stator blade 32 in the axial direction where the air flow straightening effect cannot be obtained. That is, since air passing through the holes 350 are allowed to flow directly between the stator blades 32, the directivity in the air flow direction can be maintained. Accordingly, backflow of air between the stator blades 32 is even less likely to occur. Hence, static pressure and the air blow amount of the blower 100 can be increased even more.

Figure 4A:
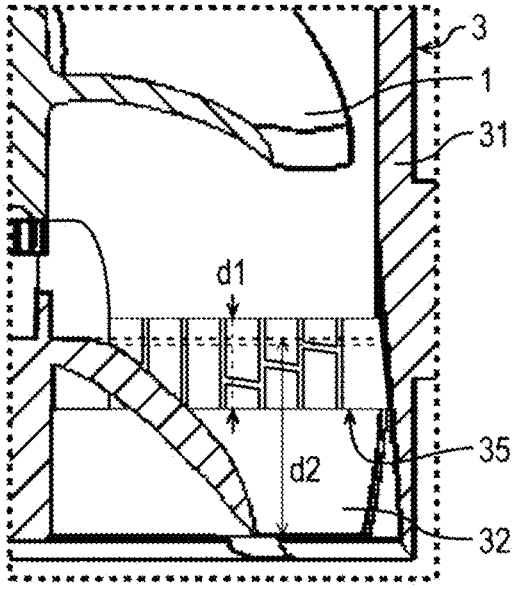
FIG. 4A is a first modification of the arrangement position of a porous wall in the axial direction according to an example embodiment of the present disclosure.

Note, however, that the axial position of the porous wall 35 is not limited to the example shown in FIG. 2. FIGS. 4A to 4E show first to fifth modifications of the axial position of the porous wall 35, respectively. For example, as shown in FIG. 4A, a part of a porous wall 35 may be provided between stator blades 32. Even with this configuration, there is no space between the porous wall 35 and the stator blade 32 in the axial direction where the air flow rectifying effect cannot be obtained. That is, since air passing through the holes 350 are allowed to flow directly between the stator blades 32, the directivity in the air flow direction can be maintained. For this reason, backflow of air toward the rotor blade 1 is even less likely to occur. Hence, static pressure and the air blow amount of the blower 100 can be increased.

Figure 4B:
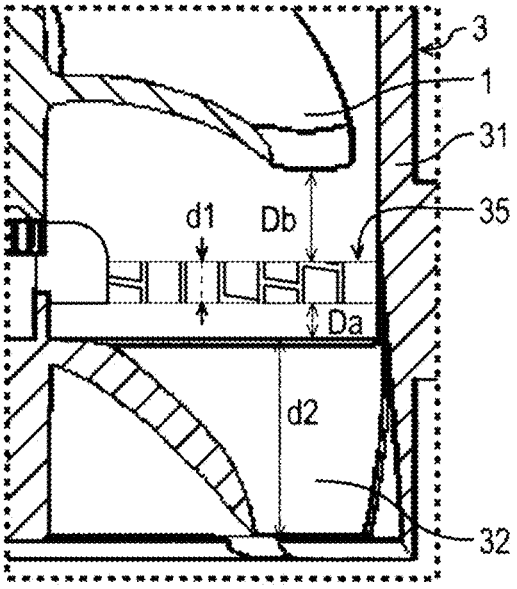
FIG. 4B is a second modification of the arrangement position of the porous wall in the axial direction according to an example embodiment of the present disclosure.
Figure 4C:
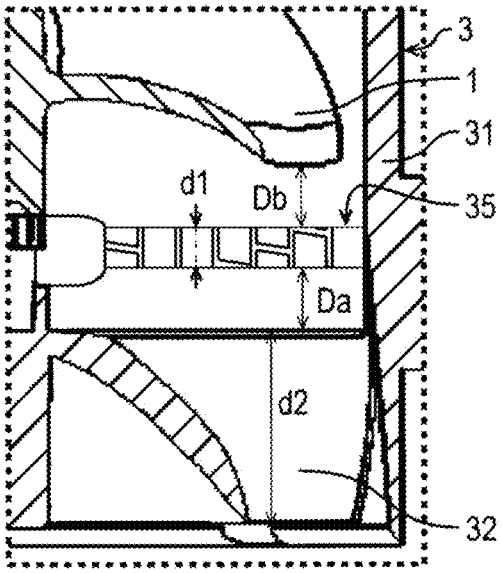
FIG. 4C is a third modification of the arrangement position of the porous wall in the axial direction according to an example embodiment of the present disclosure.
Figure 4D:
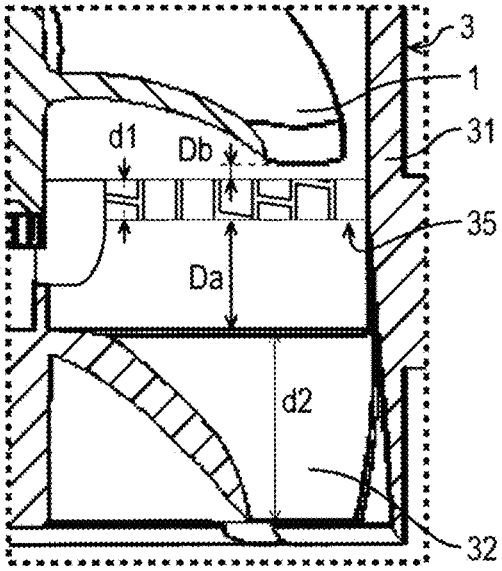
FIG. 4D is a fourth modification of the arrangement position of the porous wall in the axial direction according to an example embodiment of the present disclosure.

Alternatively, as shown in FIGS. 4B to 4D, an entire porous wall 35 may be disposed between an axially lower end portion of a rotor blade 1 and an axially upper end portion of a stator blade 32 in the axial direction. Here, an axial distance Da between the axial lower end of the porous wall 35 and the axial upper end of the stator blade 32 is preferably narrower than an axial distance Db between the axial lower end of the rotor blade 1 and the axial upper end of the porous wall 35, as shown in FIG. 4B. Note, however, that Da=Db as shown in FIG. 4C and Da>Db as shown in FIG. 4D are also conceivable. That is, in FIGS. 4B to 4D, in the axial direction, the closer the axial position of the axial lower end of the porous wall 35 is to the axial upper end of the stator blade 32, the more preferable.

Figure 4E:
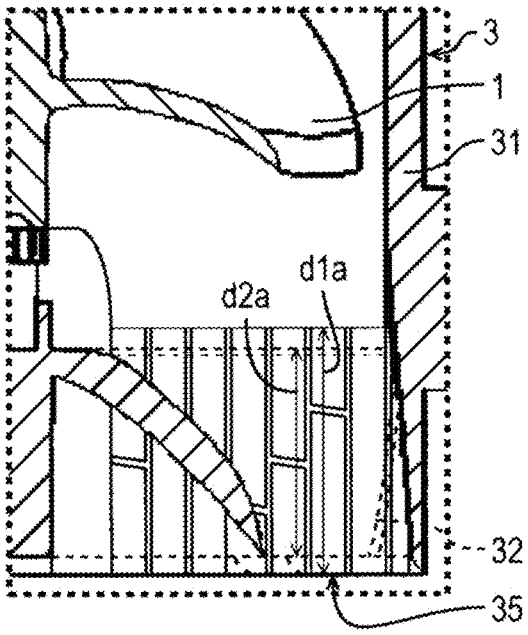
FIG. 4E is a fifth modification of the arrangement position of the porous wall in the axial direction according to an example embodiment of the present disclosure.

Note that in FIGS. 2 and 4A to 4D, the axial lower end of the porous wall 35 is disposed axially above the axial lower end of the stator blade 32. This allows the air passing through the holes 350 to flow between the stator blades 32. Note, however, that the configuration is not limited to these examples, and the axial lower end of the porous wall 35 may be disposed axially below the axial lower end of the stator blade 32 as shown in FIG. 4E. Further, in FIG. 4E, the axial upper end of the porous wall 35 is disposed axially above the axial upper end of the stator blade 32. The flow of air sent out from the rotor blade 1 is straightened by the porous wall 35 and discharged from the exhaust port 102.

In FIGS. 2 and 4A to 4D, an axial length d1 of the porous wall 35 is smaller than an axial length d2 of the stator blade. This can further reduce the air resistance when air passes through the holes 350. Accordingly, noise generated when air passes through the holes 350 can be reduced. Note, however, that the configuration is not limited to this example. For example, as shown in FIG. 4E, an axial length d1*a* of the porous wall 35 may be equal to or longer than an axial length d2*a* of the stator blade 32.

Next, as shown in FIG. 3A, the porous wall 35 further includes multiple first wall portions 351 and multiple second wall portions 352. The first wall portions 351 extend in the radial direction and are spaced apart in the circumferential direction. The second wall portions 352 extend in the axial direction and the circumferential direction, and are spaced apart in the radial direction. Additionally, the first wall portion 351 extends in the forward rotation direction Rd toward the axially lower side. In axial view, the direction in which the first wall portion 351 extends is parallel to the direction in which the hole 350 penetrates the porous wall 35, as shown in FIG. 3A.

In the example embodiment, all the holes 350 are surrounded by the first wall portions 351 adjacent in the circumferential direction and the second wall portions 352 adjacent in the radial direction. Further, in axial view, an opening surface of each hole 350 is arcuate or rectangular. Note, however, that the configuration is not limited to these examples, and some of the holes 350 may be surrounded by the first wall portions 351 and the second wall portions 352. Further, in axial view, some of the other holes 350 may not be surrounded by the first wall portions 351 and the second wall portions 352. For example, the opening surface of some of the other holes 350 may have a polygonal shape other than the rectangular shape, a circular shape, or the like. That is, at least one hole 350 is surrounded by the first wall portions 351 adjacent in the circumferential direction and the second wall portions 352 adjacent in the radial direction. With this configuration, it is possible to appropriately adjust the circumferential width and radial width of at least one hole 350 that allows passage of air by the circumferential spacing of the first wall portions 351 and the radial spacing of the second wall portions 352, respectively. Accordingly, it is possible to adjust the opening area of the hole 350 such that backflow of air in the hole 350 can be prevented.

The substrate 4 is electrically connected to an end of the conductive wire of the coil portion 223 and a connection wire (not shown) drawn to the outside of the housing 3. In the axial direction, the substrate 4 is disposed axially below the stator 22 and axially above the bracket 331 of the housing 3. Additionally, in the radial direction, the substrate 4 is disposed radially inward of the porous wall 35 of the housing 3.

Figure 5:
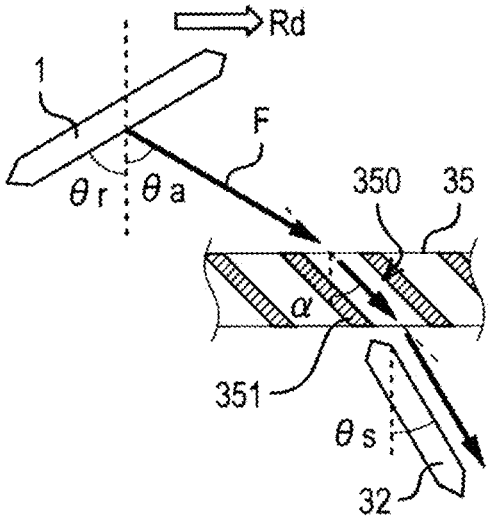
FIG. 5 is a diagram showing a penetration direction of a hole in the porous wall according to an example embodiment of the present disclosure.

Next, a penetration direction in which the hole 350 penetrates the porous wall 35 will be described. FIG. 5 is a diagram showing the penetration direction of the hole 350 in the porous wall 35.

The hole 350 penetrates the porous wall 35 in the forward rotation direction Rd toward the axially lower side. This further reduces the resistance received when the air flowing axially downward while swirling in the forward rotation direction Rd passes through the holes 350 of the porous wall 35. Accordingly, it is possible to further enhance the straightening effect caused by an air flow F passing through the holes 350 of the porous wall 35. Furthermore, even if the air backflows between the stator blades 32, the backflowed air is less likely to flow into the holes 350 of the porous wall 35.

As shown in FIG. 5, an acute angle $\alpha$ formed by the direction in which the hole 350 penetrates the porous wall 35 with respect to the axial direction is equal to or larger than an acute angle $\theta s$ formed by the stator blade 32 with respect to the axial direction. Note that the acute angle $\theta s$ of the stator blade 32 is a so-called lead angle. In radial view, the acute angle $\theta s$ is an acute angle formed by a virtual straight line connecting the axial upper end of the radially inner end portion of the pressure surface of the stator blade 32 and the axial lower end of the radially outer end portion of the pressure surface of the stator blade 32 with respect to the axial direction.

With this configuration, the air flowing through the holes 350 are allowed to flow more smoothly between the stator blades 32. Accordingly, backflow of air between the stator blades can be reduced or prevented by increasing static pressure between the stator blades 32, without reducing the air straightening effect of the porous wall 35.

Additionally, as shown in FIG. 5, the acute angle $\alpha$ formed by the direction in which the hole 350 penetrates the porous wall 35 with respect to the axial direction is equal to or smaller than an acute angle $\theta r$ formed by the rotor blade 1 with respect to the axial direction. Note that the acute angle $\theta r$ of the rotor blade 1 is a so-called lead angle. In radial view, the acute angle $\theta r$ is an acute angle formed by a virtual straight line connecting the axial upper end of the radially inner end portion of the pressure surface of the rotor blade 1 and the axial lower end of the radially outer end portion of the pressure surface of the rotor blade 1 with respect to the axial direction.

By setting $\alpha \leq \theta r$, an inclination angle $\alpha$ in the penetration direction of the hole 350 can be made equal to or smaller than an inclination angle $\theta a$ in the direction of air flow from the rotor blade 1. Note that the inclination angle $\theta a$ is an acute angle formed by the direction in which air flows due to the rotation of the rotor blade 1 with respect to the axial direction. Hence, air is allowed to flow more smoothly into the holes 350 from the rotor blade 1. Accordingly, it is possible to curb a decrease in the air blow amount of the blower 100 due to the air resistance in the porous wall 35.

The present disclosure is useful for a blower in which a stator blade is disposed axially below a rotor blade, for example.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower comprising:

a rotor blade that is rotatable about a central axis extending in an axial direction;

a motor that rotates the rotor blade; and a housing that surrounds the rotor blade and the motor; wherein the housing includes:

a plurality of stator blades extending in a forward rotation direction of the rotor blade toward an axially lower side of the blower;

a porous wall including a plurality of holes arranged in both a radial direction and in a circumferential direction; and a cylinder portion extending in the axial direction and radially outward of the porous wall;

the holes penetrate the porous wall through upper to lower surfaces thereof;

the stator blade is axially below the rotor blade; and in the axial direction, an axially upper end portion of the porous wall is between an axially lower end portion of the rotor blade and an axially upper end portion of the stator blade.

2. The blower according to claim 1, wherein the holes penetrate the porous wall in the forward rotation direction toward the axially lower side of the blower.

3. The blower according to claim 1, wherein a lower surface of the porous wall is in contact with the axially upper end portion of the stator blade.

4. The blower according to claim 1, wherein an axial lower end of the porous wall is axially above an axial lower end of the stator blade.

5. The blower according to claim 1, wherein an axial length of the porous wall is smaller than an axial length of the stator blade.

6. The blower according to claim 1, wherein the porous wall includes:

a plurality of first wall portions extending in the radial direction and spaced apart in the circumferential direction; and a plurality of second walls extending in the axial direction and the circumferential direction and spaced apart in the radial direction;

the first wall portion extends in the forward rotation direction toward the axially lower side; and at least one of the holes is surrounded by the first wall portions adjacent in the circumferential direction and the second wall portions adjacent in the radial direction.

7. The blower according to claim 1, wherein an acute angle defined by a direction in which the hole penetrates the porous wall with respect to the axial direction is equal to or larger than an acute angle defined by the stator blade with respect to the axial direction.

8. The blower according to claim 1, wherein the rotor blade extends in the forward rotation direction toward an axially upper side of the blower; and an acute angle defined by a direction in which the hole penetrates the porous wall with respect to the axial direction is equal to or smaller than an acute angle defined by the rotor blade with respect to the axial direction.

9. The blower according to claim 1, wherein the cylinder portion includes a first cylinder portion and a second cylinder portion connected to an axially lower end portion of the first cylinder portion;

a radially outer end portion of the porous wall is connected to a radially inner side surface of the first cylinder portion; and a radially outer end portion of the stator blade is connected to a radially inner side surface of the second cylinder portion.

* * * * *